United States Patent [19]

Kah, Jr.

[11] Patent Number: 4,955,542

[45] Date of Patent: Sep. 11, 1990

[54] REVERSING TRANSMISSION FOR OSCILLATING SPRINKLERS

[76] Inventor: Carl L. C. Kah, Jr., 778 Lakeside Dr., North Palm Beach, Fla. 33408

[21] Appl. No.: 245,126

[22] Filed: Sep. 15, 1988

[51] Int. Cl.[5] ..... B05B 3/16

[52] U.S. Cl. ..... 239/242; 239/237

[58] Field of Search ..... 239/237, 240, 242; 74/52

[56] References Cited

U.S. PATENT DOCUMENTS

| | | | |
|---|---|---|---|
| 3,934,820 | 1/1976 | Phaup | 239/240 |
| 4,568,024 | 2/1986 | Hunter | 239/242 |
| 4,708,291 | 11/1987 | Grundy | 239/242 |
| 4,718,605 | 1/1988 | Hunter | 239/242 |

*Primary Examiner*—Andres Kashnikow
*Assistant Examiner*—Christopher G. Trainor
*Attorney, Agent, or Firm*—Jack N. McCarthy

[57] ABSTRACT

A gear driven oscillation sprinkler head including a gear train for transmitting rotational drive from a drive motor to the oscillating sprinkler head with a shifting mechanism including a shiftable gear cage assembly which includes alternately engageable driving terminal gears with an output shaft ring gear, having a reversing toggle device and single overcenter spring device for continuously maintaining a driving engagement bias on the gear cage assembly until the reversing toggle device passes over center at which time the gear cage assembly and reversing toggle device bias simultaneously reverse for maintaining the gear cage in the alternate driving engagement position.

19 Claims, 8 Drawing Sheets

REVERSING TRANSMISSION FOR OSCILLATING SPRINKLERS

TECHNICAL FIELD

This invention relates to sprinklers where water causes the sprinkler to rotate in order to provide water precipitation over a desired area.

CROSS REFERENCE

U.S. patent application Ser. No. 932,470, filed Nov. 18, 1986, for "A TRANSMISSION DEVICE HAVING AN ADJUSTABLE OSCILLATING OUTPUT", U.S. patent application Ser. No. 037,704, filed Apr. 13, 1987, now U.S. Pat. No. 4,867,378 for "SPRINKLER DEVICE", and U.S. patent application Ser. No. 183,071, filed Apr. 19, 1988, now U.S. Pat. No. 4,901,924, for a "SPRINKLER DEVICE WITH ANGULAR CONTROL", all filed by Carl L. C. Kah, Jr., are related to this application.

BACKGROUND ART

Rotatable sprinklers have been known in the prior art for use in irrigation. Patents setting forth a background for this invention are: U.S. Pat. Nos. 3,107,056; 3,713,584; 3,724,757; 3,854,664; 4,272,024; 4,353,507; 4,568,024; and 4,625,914.

BACKGROUND OF THE INVENTION

The present invention relates to gear driven units. In my prior patent application Ser. No. 932,470, I discussed the need to maintain a continuous bias on the reversing transmission's gear cage which alternately shifts a pair of terminal gears carried on a gear cage assembly into and out of engagement with an output shaft ring gear during the period that a reversing toggle is being moved over its reversing overcenter position. Maintaining a bias on the driving terminal gear insures that it will not become disengaged during stopping or starting of the drive when the reversing toggle bias is in the process of being reversed.

SUMMARY OF THE INVENTION

In this invention, a reversing toggle's overcenter bias in either direction is used to bias the gear cage assembly in its driving position in either direction, and at a neutral center reversing toggle position, any gear cage movement towards premature disengagement of the driving terminal gear changes the overcenter relationship of a camming plate device with relation to the reversing toggle to reverse the bias for the desired reversing action. In this configuration, there is no need for one biasing means to have to overpower another biasing means.

It is an object of this invention to provide an improved reversing drive means with a single interacting bias means between a reversing toggle device and a gear cage assembly that simultaneously reverses the gear cage assembly and reversing toggle device bias while maintaining a continuous bias on the gear cage assembly and driving terminal gear up until the moment of reversal movement for engaging the alternate terminal gear and reversed driving of the sprinkler's output shaft.

An object of this invention is to provide a reversing drive means for an output gear, said drive means having a single interacting biasing means between a reversing toggle device actuated by said output gear and a gear cage assembly having two drive gears for alternate engagement with said output gear for driving it in a clockwise or counter-clockwise direction, said single interacting biasing means maintaining a continuous bias on the gear cage assembly to maintain one of the drive gears in driving contact with said output gear until said reversing toggle device has been moved to center position with said single interacting biasing means where further overcenter movement simultaneously reverses the direction of bias on the toggle device and gear cage assembly to maintain a continous bias on the gear cage assembly to maintain the other drive gear in driving contact with said output gear.

It is another object of this invention to provide an improved reversing drive means with a single interacting bias means which provides a biasing force between a reversing toggle device and gear cage assembly through a camming plate device and overcenter spring that simultaneously reverses the bias between the camming plate device and the reversing toggle device while maintaining a continuous bias on the gear cage assembly and driving terminal gear up until the moment of reversal movement for engaging the other terminal gear for reversed driving of the sprinkler's output shaft.

A further object of the invention is to simplify the assembly of the reversing gear drive assembly by reducing the number of biasing springs and by mounting the one biasing spring so that it can easily be assembled.

It is another object of the invention to provide for engagement of said gear cage assembly by said reversing toggle means to aid in placing and maintaining a terminal gear in a driving relationship with an output gear.

BEST MODE FOR CARRYING OUT THE INVENTION

Figure 1:
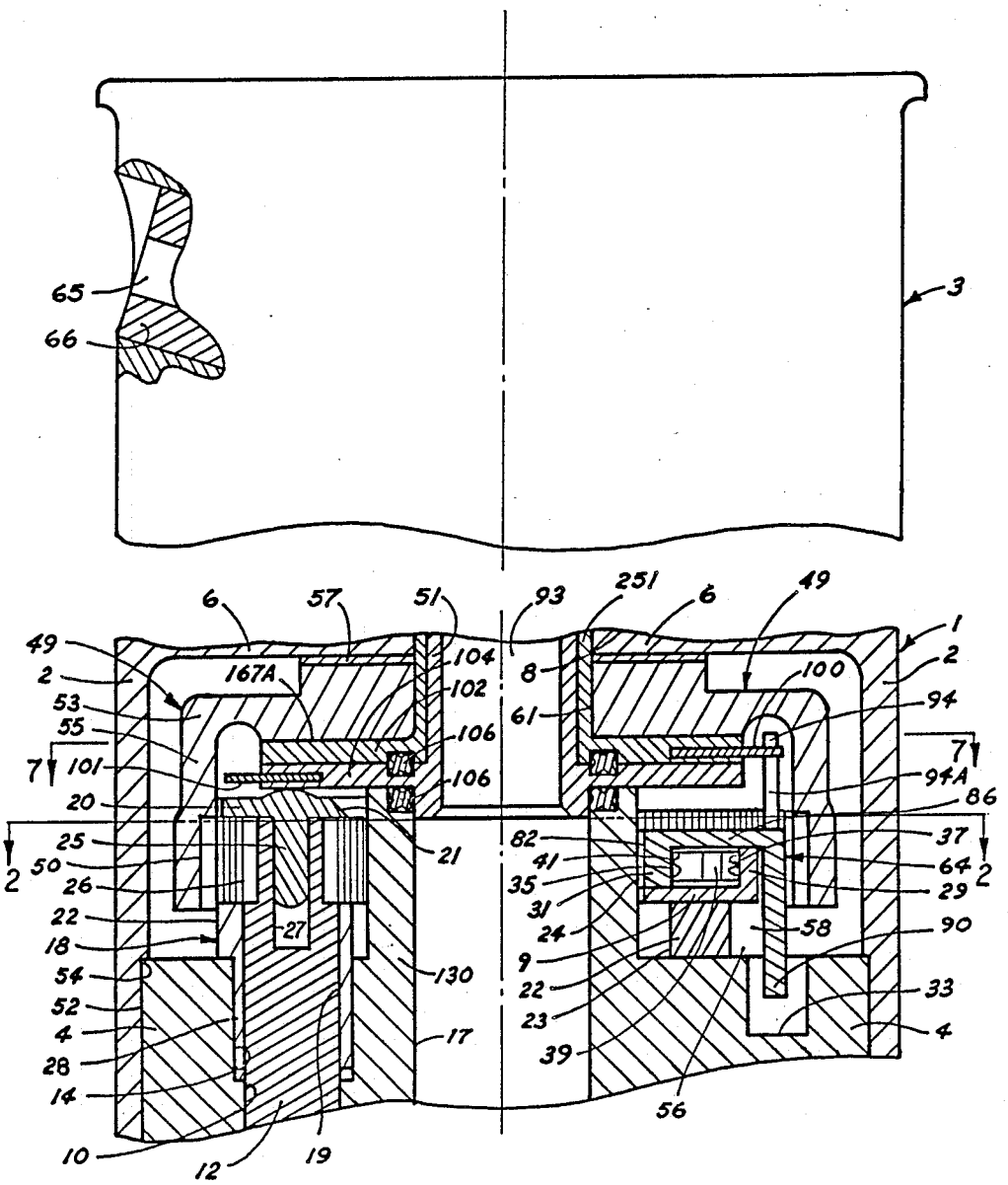
FIG. 1 is a fragmentary side elevational view of a sprinkler showing the upper rotating nozzle and reversing drive in section, with spring seats aligned.

Referring to FIG. 1 of the drawings, a sprinkler transmission device 1 is shown having a cylindrical housing 2 positioned over and fixed to a base member 4. Cylindrical housing 2 has an integral cover 6 having a center outlet opening 8 for a purpose to be hereinafter described. The end of cylindrical housing 2 over base member 4 has a circumference of an increased inner diameter 52 forming an annular step 54. Base member 4 is positioned in the increased diameter 52 of cylindrical housing 2 against the annular step 54.

Base member 4 has an opening 10 therethrough positioned to one side for receiving a rotary input shaft 12. Rotary input shaft 12 can be driven by a fluid turbine, which is enclosed in the lower part of housing 2.

A reversing gear cage assembly 18 is positioned within said cylindrical housing 2 adjacent said base member 4 and the reversing gear cage assembly 18 is formed having a top plate 20 and a bottom plate 22 with cooperating center openings 21 and 23, respectively. The bottom plate 22 has an opening 19 therein to receive the rotary input shaft 12, the upper end of which is formed as a spur gear 26. Spur gear 26 is shown without teeth in FIGS. 2, 3, 4, and 5, showing the pitch circle. A cylindrical shaft 28 extends downwardly from the bottom of the bottom plate 22 around opening 19 and extends into the enlarged upper part 14 of the opening 10 to provide for pivotal movement of the reversing gear cage assembly 18 while the cylindrical shaft 28 properly positions the input shaft 12 and spur gear 26. An integral shaft 25 extends downwardly from the bottom of top plate 20 to engage a cylindrical opening 27 extending downwardly from the top of input shaft 12 through the centerline of the spur gear 26.

Figure 2:
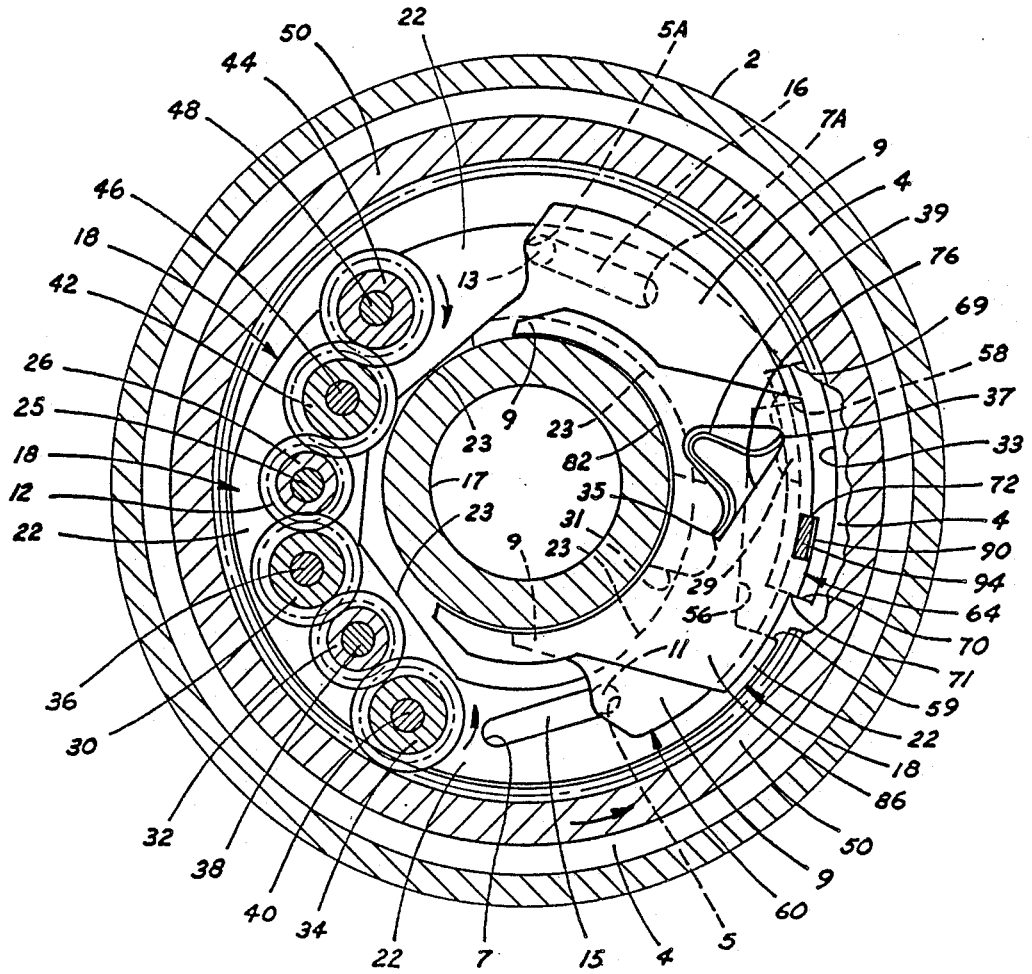
FIG. 2 is a transverse sectional view taken on line 2—2 of FIG. 1 showing the gear cage assembly in its fully clockwise position for driving the output ring gear for counter-clockwise rotation. The reversing toggle device is shown in its fully clockwise position with the gear cage camming plate device in its fully counter-clockwise position.
Figure 3:
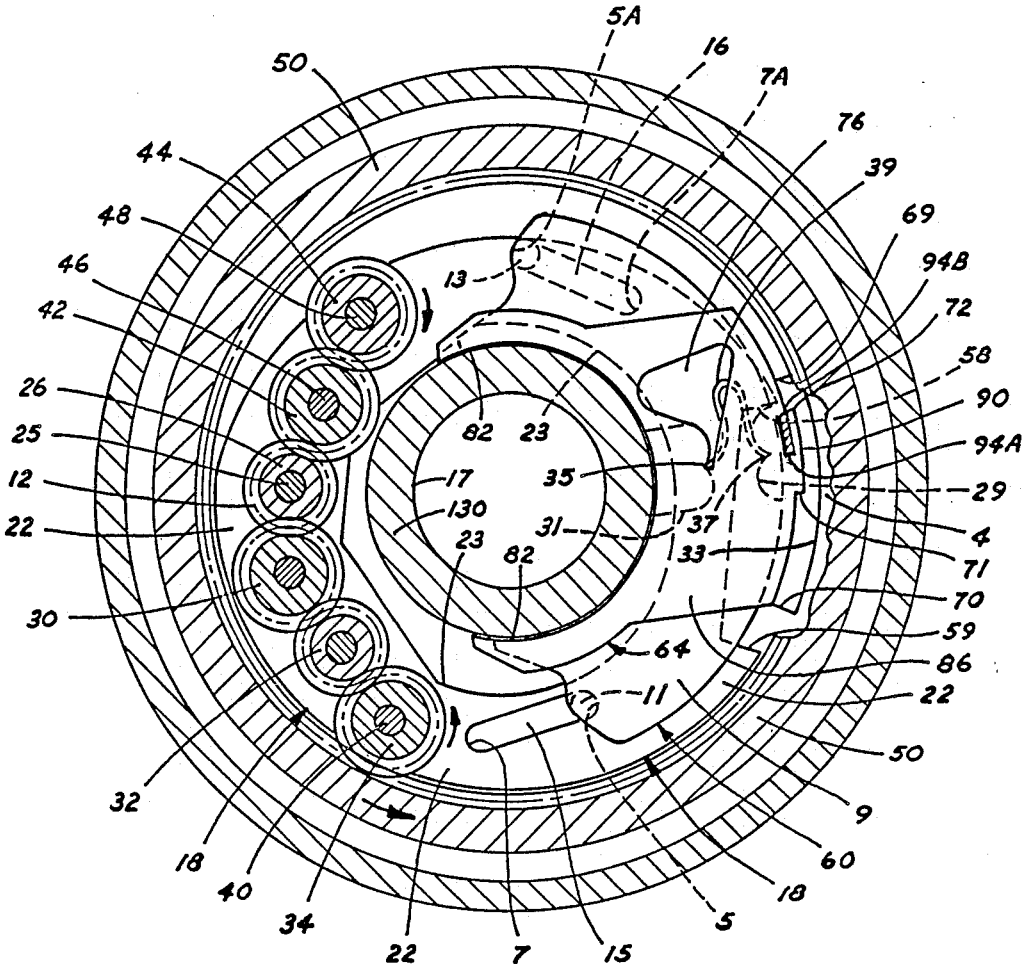
FIG. 3 is a sectional view similar to FIG. 2 taken on line 2—2 of FIG. 1 showing the gear cage in its fully clockwise position but with the reversing toggle device having been moved counter-clockwise to an overcenter biasing spring's neutral position. The gear cage camming plate device is still in its fully counter-clockwise position.
Figure 4:
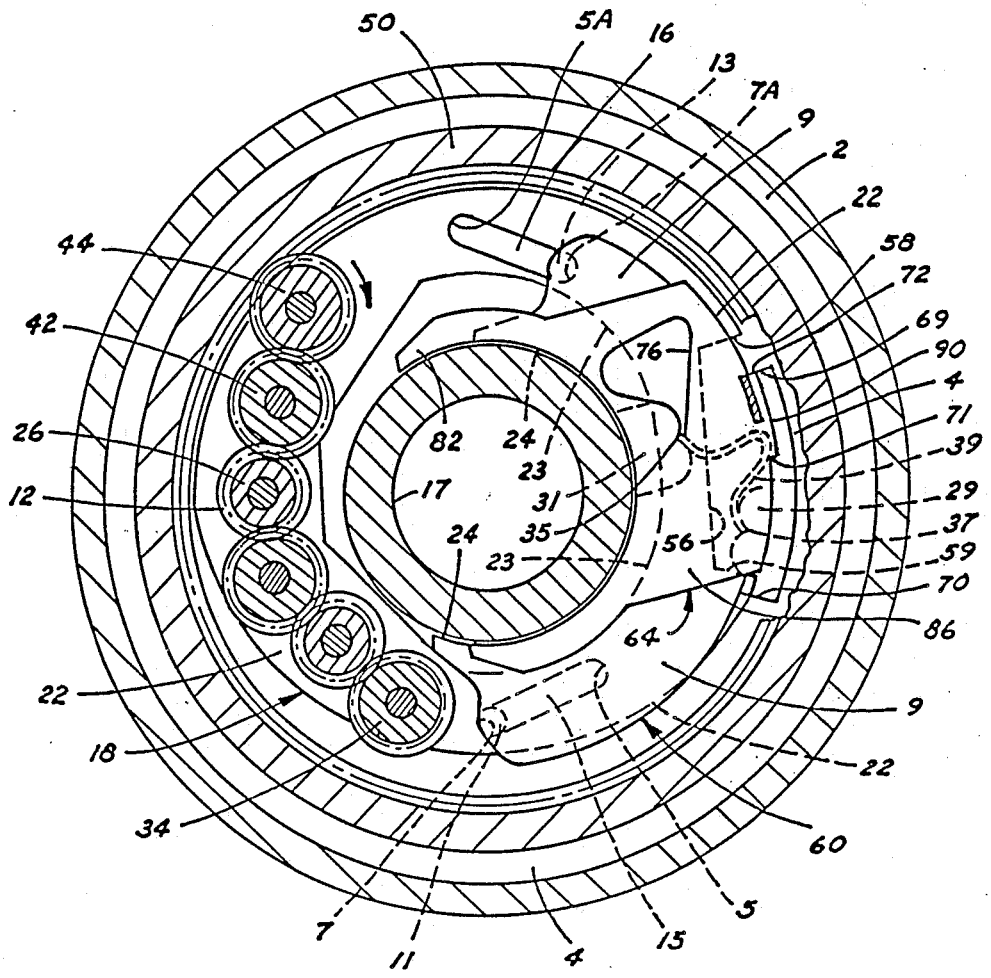
FIG. 4 is a sectional view similar to FIG. 2 taken on line 2—2 of FIG. 1 showing the gear cage assembly in its fully counter-clockwise position for driving the output shaft for clockwise rotation and with the reversing toggle device in it fully counter-clockwise position. The gear cage camming plate device is shown in its fully clockwise position.
Figure 5:
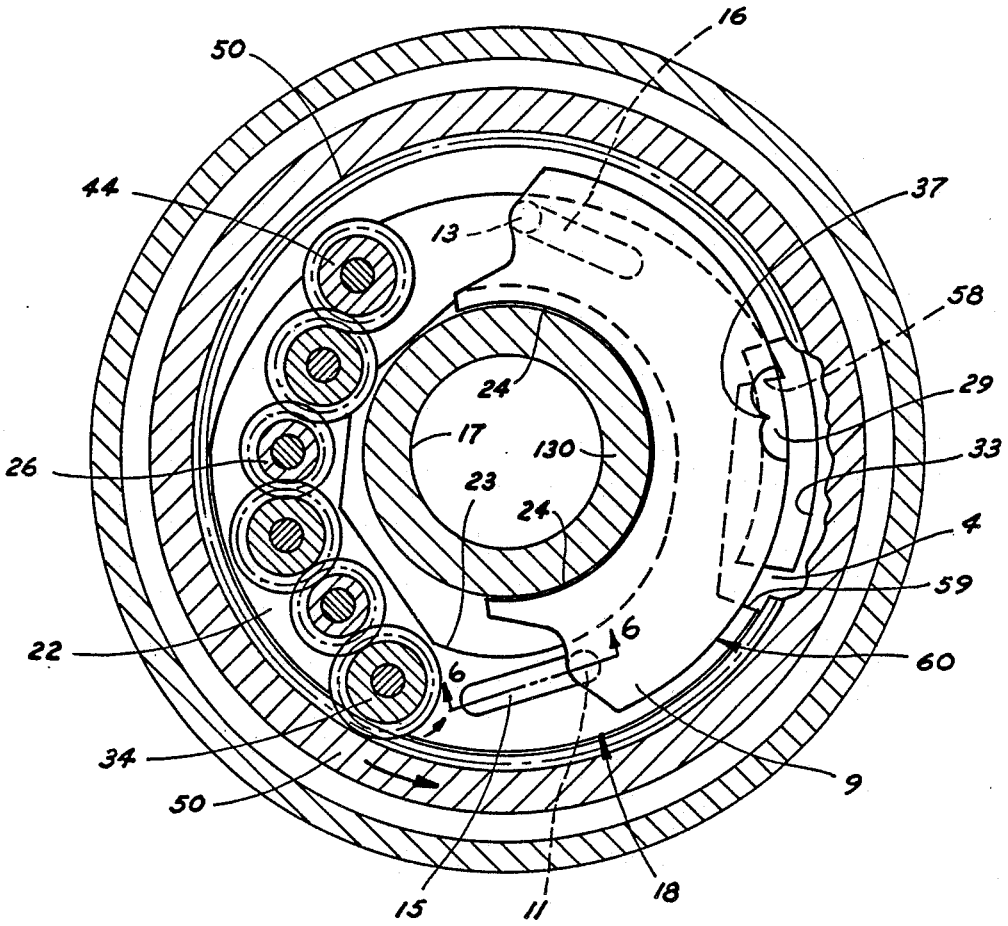
FIG. 5 is a sectional view similar to FIG. 2 taken on line 2—2 of FIG. 1 but with the toggle device and biasing spring removed showing the gear cage assembly and gear edge camming plate device in their respective positions for counter-clockwise driving of the output ring gear, positioned as in FIG. 2.
Figure 6:
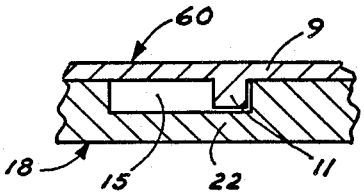
FIG. 6 is a vertical partial sectional view taken along the line 6—6 of FIG. 5 showing the camming pin of the gear cage camming plate device positioned in the gear cage assembly camming slot.

As shown in FIGS. 2, 3 and 4, three gears 30, 32 and 34 are mounted on integral shafts 36, 38 and 40 extending downwardly from top plate 20 of the reversing gear cage assembly 18 and they extend in a counter-clockwise direction from the integral shaft 25. Gears 30, 32 and 34 are shown without teeth, showing the pitch circles. Integral shaft 36 is positioned so that gear 30 will engage the spur gear 26; shaft 38 is positioned so that gear 32 will engage gear 30; and shaft 40 is positioned so that gear 34 engages gear 32 and extends outwardly over the edges of top plate 20 and bottom plate 22 so that it can drivingly engage an output ring gear 50, encircling the reversing gear cage assembly 18 between the top plate 20 and the bottom plate 22. Ring gear 50 is shown without internal teeth, showing the pitch circle. Output ring gear 50 is formed as a part of output driving member 49. Output driving member 49 will be hereinafter discussed as to its structure and use.

The output driving member 49 consists of ring gear 50 surrounding the reversing gear cage assembly 18, a cylindrical member 55 extending upwardly from ring gear 50 connects to an annular radial flange member 53 with a center opening 61 through which output shafts 51 and 251 extend upwardly.

Two gears 42 and 44 are mounted on integral shafts 46 and 48 extending downwardly from top plate 20 of the reversing gear cage assembly 18 and they extend in a clockwise direction from the integral shaft 25. Gears 42 and 44 are shown without teeth, showing the pitch circles. Integral shaft 46 is positioned so that gear 42 will engage the spur gear 26 and shaft 48 is positioned so that gear 44 engages gear 42 and extends outwardly over the edges of top plate 20 and bottom plate 22 so that it can drivingly engage said output ring gear 50. Integral shafts 36, 38, 40, 46 and 48 of top plate 20 extend into matched openings in bottom plate 22 and have a snap engagement at their ends with said openings to fix said top plate 20 and bottom plate 22 of the reversing gear cage assembly 18 together.

A notched area 56 extends across the opposite side of the center opening 23 of the lower gear cage plate 22 from that the input shaft opening 19. This notched area provides shifting contact surfaces identified as 58 and 59. Said arrangement permits arcuate movement of contact surfaces 58 and 59 about the center of opening 14, cylindrical shaft 28 and spur gear 26, as reversing gear cage assembly 18 is moved between its clockwise driving position and counter-clockwise driving position.

It can be seen that when the reversing gear cage assembly 18 is positioned clockwise around input shaft 12, as shown in FIG. 2, the gear 34 is engaging the ring gear 50. With the rotary input shaft 12 being driven clockwise, the two idler gears 30 and 32 will rotate drive gear 34 counter-clockwise, imparting a counter-clockwise rotation to output ring gear 50. When the reversing gear cage assembly 18 is positioned counter-clockwise around input shaft 12, as shown in FIG. 4, the gear 44 is engaging the ring gear 50. With the rotary input shaft 12 being driven clockwise, the one idler gear 42 will rotate the drive gear 44 clockwise, imparting a clockwise rotation to output ring gear 50.

To bias the reversing gear cage assembly 18 in a clockwise direction to have gear 34 engage ring gear 50, or bias the reversing gear cage assembly 18 in a counter-clockwise direction to have gear 44 engage ring gear 50 for oscillating movement of output ring gear 50, a reversing camming plate device 60 is positioned above the gear cage bottom plate 22 and has two gear cage camming pins 11 and 13 which protrude downwardly into gear cage position camming slots 15 and 16, respectively, in the top surface of the gear cage's bottom plate 22 as shown in FIGS. 2–6.

The reversing camming plate device 60 is formed having a C-shaped plate 9 with an arcuate inner surface 24 greater than 180 degrees positioned around the cylindrical member 130 which extends upwardly from, and is part of, the base member 4. To maintain a biasing force on reversing gear cage assembly 18 through reversing camming plate device 60, an upwardly projecting member 29 with a spring seat notch 37 formed therein is located on the top surface of the C-shaped plate 9 and will be hereafter discussed.

A reversing toggle device 64 is positioned just above the reversing camming plate device 60 and is also positioned around the cylindrical member 130 of base member 4. The reversing toggle device 64 is also formed with a C-shaped inner opening 82 at the inner end of a radial arm 86 and positioned for partial rotation around cylindrical member 130. An actuation arm 94 extends upwardly from the radial arm 86 of toggle device 64 for contact by radial contact members 100 and 101 rotated by ring gear 50 to rotate reversing toggle device 64 in a counter-clockwise or clockwise direction, respectively, (actuating mechanism shown in U.S. application Ser. No. 183,071, filed Apr. 19, 1988).

A position biasing overcenter spring projection 31 with notch 35 protrudes downwardly adjacent the inner opening 82 of the radial arm 86. An opening 76 is provided in the radial arm surface 86 to allow installation of an overcenter spring means 39 which extends between spring seat notch 35 on the projection 31 of reversing toggle device 64 and the cooperating spring seat notch 37 on projecting member 29 of the reversing camming plate device 60.

The overcenter spring means 39 as shown is formed from ribbon-like spring material; for example, stainless steel, and shaped with an intermediate arcuate position and oppositely directed straight portions to engage the spring seat notches 35 and 37. Each end of the straight portions has serrations 41 to grip the spring seat notches. Other types of overcenter spring means can be used.

In FIG. 2 the gear cage assembly 18 is shown biased to its fully clockwise position with terminal driving gear 34 engaging ring gear 50 for counter-clockwise driving rotation of the output shaft. The reversing toggle device 64 is shown biased to its fully clockwise position, a side surface 71 of a downwardly protruding arm 90 on reversing toggle device 64 being placed against an end surface 70 of a cavity 33 in base member 4, overcenter biasing spring 39 holding the reversing camming plate device 60 in its fully counter-clockwise position. The reversing camming plate device 60 camming pins 11 and 13 are in their counter-clockwise position in the gear cage position camming slots 15 and 16 which forces the gear cage assembly 18 to its fully clockwise position as shown.

In FIG. 3 the reversing toggle device 64 has been rotated counter-clockwise by an arc control contact member 100 rotated by ring gear 50 acting against a surface 94A on actuation arm 94 as the ring gear 50 was driven counter-clockwise to a spring means 39 center position, radially aligning spring seat notches 35 and 37. At this position the bias on the reversing toggle device 64 and reversing camming plate device 60 becomes zero prior to its being carried further counter-clockwise.

As contact member 100 continues to be driven counter-clockwise by ring gear 50 a surface 72 of downwardly protruding arm 90 on the reversing toggle device 64 contacts surface 58 of the notched area 56 of the lower gear cage plate 22 to exert additional force counter-clockwise as required to cause the counter-clockwise driving terminal gear 34 to be disengaged from the ring gear 50 and allow the now reversed biasing force of spring 39 to cause the camming plate device 60 to be moved clockwise. This action then causes the gear cage assembly 18 to be cammed counter-clockwise by the action of the camming pins 11 and 13 against the sloped sides of gear cage camming slots 15 and 16, respectively.

The reversing toggle device 64 moves to its fully counter-clockwise position as stopped by a side surface 72 of the downwardly protruding arm 90 against an end surface 69 of cavity 33 in the upper surface of base member 4. The downwardly protruding arm 90 positioned in cavity 33 limits the travel of the reversing toggle device 64 between the ends 69 and 70 of the cavity 33 to permit the overcenter spring means 39 to bias the camming plate device 60 to its operative clockwise or counter-clockwise position.

The action of overcenter spring means 36 now forces the camming plate 60 fully clockwise and the gear cage fully counter-clockwise engaging the clockwise driven terminal gear 44 with the output ring gear 50 as shown in FIG. 4, completing the reversing action.

However, if stopped at this neutral point when there is no longer an engagement bias on the gear cage assembly 18 through reversing camming plate device 60, if the gear cage assembly 18 should move to disengage the driving gear 34, by any action, intended or otherwise, then this movement will cam rotate the reversing camming plate device 60 clockwise carrying its upward projection 29 and its overcenter spring notch 37 overcenter clockwise and the reversing biasing is immediately reapplied in a clockwise direction for the reversing camming plate device 60 and counter-clockwise direction for the reversing toggle device 64 and initiate the reversing action and restart driving engagement bias.

This same action is repeated in the other direction as contact member 101 is rotated clockwise and eventually contacts the toggle device actuation arm 94 on it surface 94B and begins to carry the reversing toggle device 64 back counter-clockwise.

During the entire movement of the reversing toggle device 64, note that the biasing spring means 39 is exerting a force on the camming plate device 60 except just as the spring seat notches 35 and 37 of projections 31 and 29, respectively, are in radial alignment, one example shown in FIG. 3, and then if the gear cage assembly 18 should move to disengage its engaged gear 34 or 44, the upwardly projecting member 29 will be moved, by camming, out of its neutral center position to one side to complete the reversing action of overcenter spring 39.

Output ring gear 50 of output driving member 49 is mounted for concentric rotation and driving engagement with output shafts 51 and 251. Driving engagement between output driving member 49 and the outer output shaft 251 is achieved by a lightly serrated frictional area 167A formed between radial flange 102 and under surface of radial flange member 53. This arrangement provides a torque limiting clutch action.

Concentric output shafts 251 and 51 pass through the center hole 61 in the output driving member 49, through a thrust bearing washer 57, out of cylindrical housing 2 through its center opening 8 and are locked together in a nozzle assembly 3 or may be a single piece. Means can be provided to change the angular relation of shafts 251 and 51 and respective contact members 100 and 101, if desired.

The inner concentric output shaft 51 also has a radial annular flange 104. Both radial flange 102 of output shaft 251 and radial flange 104 of output shaft 51 have flexible radial contact members 100 and 101 which are arcuately positioned as desired to achieve the desired oscillation arc control by their action when contacting the actuation arm 94 of reversing toggle device 64 as was previously discussed. These radial contact members can be rigid, if desired.

Having these contact members flexible has the advantage of preventing damage to the gear drive's reversing mechanism should the sprinkler nozzle be forceably rotated externally. Should this occur, the gear drive and reversing mechanism is protected by the clutching action of driving serrated frictional area 167A and the bending of contact member 100 or 101 to allow them to pass actuation arm 94 without breaking it.

The upstanding cylindrical member 130 of base member 4 has an annular groove around its inner top surface in which a resilient seal 106 is placed to separate the water from direct access to the gear box. Another seal 106 is placed between annular flanges 102 and 104 to prevent water from entering the gear box from the nozzle.

Water passes up through the center of the base member through hole 17 in cylindrical member 130 and up through the hollow center of output shaft 51 into the rotating nozzle assembly 3 for ejection out of the nozzle opening 65. Details of this construction are shown in U.S. patent application Ser. No. 183,071, filed Apr. 19, 1988.

Figure 8:
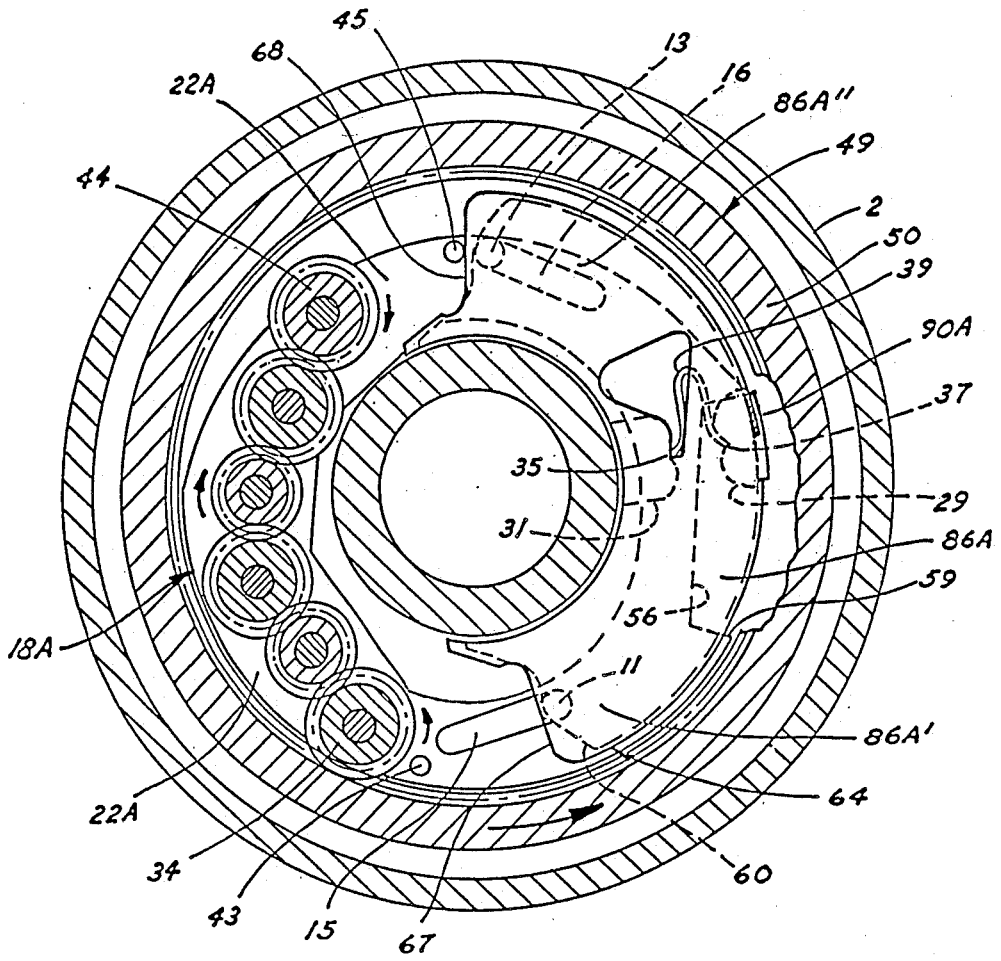
FIG. 8 is a transverse sectional view taken on the line 2—2 of FIG. 1 showing a modified toggle device and gear cage assembly where material has been added to both sides of the reversing toggle arm to contact stop posts that are upstanding on either side of the gear cage assembly; the modified toggle device is shown having been rotated counter-clockwise to an overcenter bias spring neutral position just prior to it being carried over center for a reversing action, with the gear cage still in its fully clockwise position for counter-clockwise driving of the output ring gear.
Figure 9:
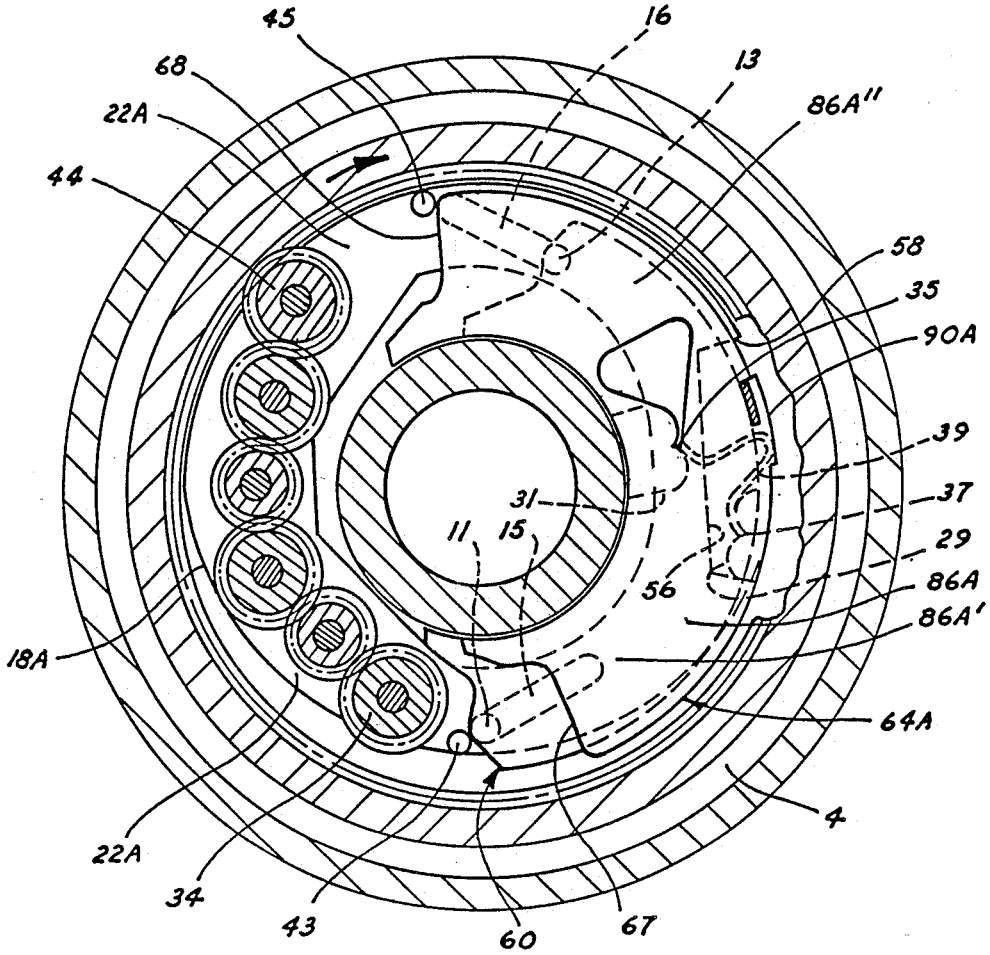
FIG. 9 is a transverse sectional view similar to FIG. 8 where the toggle device has been carried counter-clockwise over center and the reversing action has occurred showing the gear cage camming plate device in a fully clockwise position and the gear cage assembly cammed to its fully counter-clockwise position for clockwise driving of the output ring gear.

A modified sprinkler transmission device 1A is shown in FIGS. 8 and 9. Changes are made to the reversing toggle device 64A and gear cage assembly 18A; further, the cavity 33 in base member 4 can be omitted with the use of the reversing toggle device 64A.

The modified toggle device 64A is shown in FIG. 8 where instead of its rotational travel position being limited by a downwardly protruding arm 90A thereon below the gear cage bottom plate 22A being stopped against one end or the other, 69 or 70, of base member cavity 33, the radial arm 86A has extensions 86A' and 86A" added to the radial arm 86 forming a larger arcuate segment 86A having a first stop contact surface 67 on one end and a second contact surface 68 on the other end, for engaging a stop post 43 fixed to gear cage bottom plate 22A adjacent gear 34 and a stop post 45 fixed to gear cage bottom plate 22A adjacent gear 44, respectively. Downwardly protruding arm 90 is cut off below bottom plate 22A to form protruding arm 90A. In this arrangement, the rotational force of the overcenter spring means 39 acting on the reversing toggle device 64A is applied to the gear cage assembly 18A and adds to the force of the camming plate device 60 as the toggle device 64A is carried over center to help move the gear cage assembly 18A from one rotational direction driving position to the other rotational direction driving position.

This is accomplished not only by arm 90A being able to contact one end or the other, 58 or 59, of the gear notched area 56 for a best lever arm mechanical advantage for disengaging a driving terminal gear, 34 or 44, from the output ring gear 50 (gear cage assembly 18A is pivoted around input shaft 12) but by stop contact surfaces 67 or 68 of the modified toggle device 64A, contacting the upstanding stop posts 43 or 45, respectively, that have been added to either side of the modified lower gear cage plate 22A. The contact of a reversing toggle device stop contact surface, 67 or 68, with a gear cage stop, post 43 or 45, respectively, should preferably not occur until after the reversing toggle device 64A has been driven over the reversing action center of the overcenter spring means 39.

Figure 7:
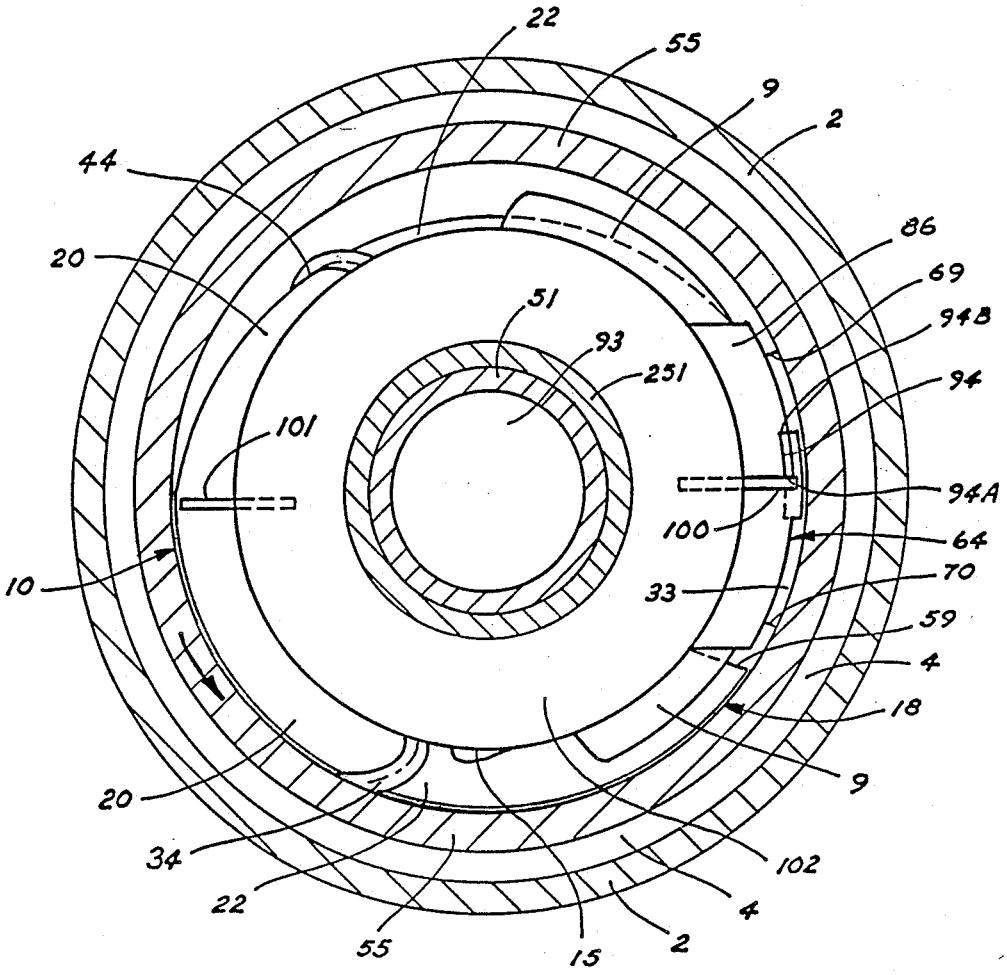
FIG. 7 is a transverse sectional view taken on line 7—7 of FIG. 1 showing the flexible contact member on the radial flange of the outer output and arc set shaft contacting the rigid upstanding projection means on the toggle device, having driven the reversing toggle counter-clockwise to the position shown in the elevational cross-section of FIG. 1.

As shown in FIG. 9, as the output ring gear 50 is continued to be driven counter-clockwise by terminal gear 34 with the gear cage assembly 18A still fully clockwise, the reversing toggle device 64A continues to be carried counter-clockwise by flexible arc control contact member 100, as shown in FIG. 7, the toggle arm 90A contacts surface 58 of the gear cage notched area 56 for the maximum lever arm mechanical advantage (since the gear cage is pivoted around the input shaft 12 on the far opposite side) for forcing the driving terminal gear 34 out of driving engagement with the ring gear 50. The downwardly projecting member 31 of reversing toggle device 64A has now been moved counter-clockwise over its center relationship to the upward projection 29 of the camming plate device 60. This action reverses the biasing force of overcenter spring means 39 on both the reversing toggle device 64A and the camming device 60 initiating the reversing action previously described.

For the geometry and mechanical arrangement of the components shown, the contact surface 68 contacts the gear cage stop post 45 at about the same time as the reversing toggle device 64A passes the center position and the force of the overcenter spring means 39 on the reversing toggle device 64A for the reversing action now also tries to move the reversing toggle device 64A in a counter-clockwise direction. This counter-clockwise toggle force is now also added to the gear cage assembly 18A through contact surface 68 to the gear cage assembly 18A through stop post 45. This is an additive force for moving the gear cage assembly 18A counter-clockwise to that being provided by the force in a clockwise direction on the camming plate device 60 to cam the gear cage assembly 18A counter-clockwise by the action of camming pin 11 and 13 in gear cage position camming slots 15 and 16, respectively.

For the modified reversing drive shown, the angular displacement of the stop posts 43 and 45 about their rotational center relative to the angular displacement of the stop contact surfaces 67 and 68 about the rotational center of reversing toggle device 64A after said spring seat notches 35 and 37 have been aligned is relatively small so that as the rotating toggle device 64 continues to be forced counter-clockwise by the reaction of the overcenter spring means 39 required to force the camming plate device 60 clockwise even when the gear cage assembly 18A is shifted fully counter-clockwise, the completely shifted stopped position of the modified reversing toggle device 64A against the stop post 45 prevents it from being rotated so far that overcenter spring means 39 is allowed to escape from its containment notches 35 and 37 in the projection 31 and projecting member 29, respectively.

For low torque drives or gearing geometry where the terminal driving gears 34 or 44 are easily disengaged from the output ring gear 50, the notched area 56 and downwardly protruding arm 90A may be eliminated for the modified reversing toggle device 64A and gear cage 18A configuration, further simplifying the mechanical operation, tolerances and parts.

I claim:

1. An oscillating transmission for use with an oscillating sprinkler head having an output gear, a gear cage means with two drive gears, a first drive gear and a second drive gear for alternately driving said output gear to oscillate it, means mounting said gear cage means for movement, reversing toggle means mounted for movement adjacent said gear cage means, a single interacting overcenter biasing means mounted between said reversing toggle means and said gear cage means for biasing said gear cage means and said reversing toggle means in the same direction on opposite sides of a center position for driving said output gear by said gear cage means, means for moving said reversing toggle means to move it over its center position to bias said gear cage means and said reversing toggle means in the opposite direction, said means for moving said reversing toggle means being connected to said output gear.

2. A combination as set forth in claim 1 wherein said single interacting overcenter biasing means maintains a continuous bias on the gear cage means to maintain a continuous driving force between one drive gear of said gear cage means and said output gear.

3. A combination as set forth in claim 1 wherein said single interacting overcenter biasing means includes a camming plate means mounted for movement in the opposite direction from said reversing toggle means and gear cage means, said camming plate movement acting to cam said gear cage means into a driving relationship with said output gear.

4. A combination as set forth in claim 1 wherein said reversing toggle means is biased to contact said gear cage means to aid in moving said gear cage means into a driving relationship with said output gear.

5. A combination as set forth in claim 1 wherein said reversing toggle means is constructed to contact said gear cage means after said reversing toggle means passes over a center position to aid in moving said gear cage means into a driving relationship with said output gear.

6. A combination as set forth in claim 1 wherein said reversing toggle means cams said gear cage means to move it.

7. A combination as set forth in claim 3 wherein said single interacting overcenter biasing means includes a single spring mounted between said camming plate means and said reversing toggle means for biasing said camming plate means and said reversing toggle means in opposite directions on opposite sides of a center position.

8. A combination as set forth in claim 1 wherein said single interacting overcenter biasing means has two center positions, one center position occurring when said reversing toggle means is moved in one direction and a second center position occurring when said reversing toggle means is moved in the opposite direction.

9. A combination as set forth in claim 5 wherein said gear cage means has a cam groove therein, said camming plate means having a cam projection extending therefrom into said cam groove whereby movement of said camming plate means in one direction cams said gear cage means in the opposite direction.

10. An oscillating transmission for use with an oscillating sprinkler head having an output gear, a gear cage assembly with two drive gears, a first drive gear and a second drive gear for alternately driving said output gear to oscillate it, means mounting said gear cage assembly for pivotal movement, reversing toggle means mounted for pivotal movement adjacent said gear cage assembly, a single interacting overcenter biasing means mounted between said gear cage assembly and reversing toggle means to maintain a position of the gear cage assembly to provide a driving relationship between one drive gear of said gear cage assembly and said output gear, means for moving said reversing toggle means over a center position of said single interacting overcenter biasing means for reversing the bias on said gear cage assembly to provide driving engagement between the other drive gear of said gear cage assembly and output gear.

11. A combination as set forth in claim 10 wherein said single interacting overcenter biasing means includes a camming plate means mounted for pivotal movement between said gear cage assembly and reversing toggle means and a single overcenter spring means, means connecting said camming plate means to said gear cage assembly for actuating it, said camming plate means and reversing toggle means being biased in reversed opposite directions on opposite sides of a center position.

12. A combination as set forth in claim 11 wherein said means connecting said camming plate means to said gear cage assembly includes a cam groove in said gear cage assembly and a cam projection on said camming plate means, said cam projection extending into said cam groove for moving said gear cage assembly by movement of said camming plate means.

13. A combination as set forth in claim 12 wherein said gear cage assembly has a top plate and a bottom plate with said drive gears mounted therebetween, said camming plate means being mounted over said top plate of said gear cage assembly, said cam groove being located in said top plate.

14. An oscillating transmission for use with an oscillating sprinkler head having an output gear, a gear cage means with two drive gears, a first drive gear and a second drive gear for alternately driving said output gear to oscillate it, means mounting said gear cage means for movement, camming plate means mounted for movement adjacent said gear cage means, cam means interconnecting said gear cage means and camming plate means so that moving said camming plate means in one direction cams said gear cage to drivingly engage said first drive gear with said output gear and moving said camming plate means in the other direction cams said gear cage to drivingly engage said second drive gear with said output gear, reversing toggle means mounted for movement adjacent said camming plate means, overcenter spring means mounted between said reversing toggle means and camming plate means for biasing said camming plate means and reversing toggle means in opposite directions on each side of a center position, means for moving said reversing toggle means to move it over a center position to bias said camming plate means in the opposite direction, said means for moving said reversing toggle means being connected to said output gear.

15. A combination as set forth in claim 14 wherein said overcenter spring means is a single spring mounted between said camming plate means and reversing toggle means.

16. A combination as set forth in claim 15 wherein said single spring has two center positions, one center position occurring when said reversing toggle means is moved in one direction and a second center position occurring when said reversing toggle means is moved in the opposite direction.

17. A combination as set forth in claim 14 wherein said reversing toggle means has a first spring seat thereon extending towards said camming plate means and said camming plate means has a second spring seat thereon extending towards said reversing toggle means, said overcenter spring means being mounted between said first and second spring seats.

18. A combination as set forth in claim 17 wherein said reversing toggle means has an opening therein to insert said overcenter spring means therethrough to be placed between said first and second spring seats of said camming plate means and a reversing toggle means.

19. An oscillating sprinkler having an oscillating transmission, said oscillating transmission having an output gear, a gear cage means with two drive gears, a first drive gear and a second drive gear for alternately driving said output gear to oscillate it, a reversing toggle means adjacent said gear cage means, a single overcenter spring means mounted between and coacting with said reversing toggle means and gear cage means to place a rotational force thereon, said rotational force continuously maintaining a driving engagement between one of said drive gears and said output gear, means for moving said reversing toggle means against the force of said single overcenter spring means over a center position of said single overcenter spring means, the rotational force on said gear cage means and reversing toggle means simultaneously reverses for maintaining the other drive gear of the gear cage means in the alternate driving engagement position.

* * * * *